US010051918B2

(12) United States Patent
Dombrow et al.

(10) Patent No.: US 10,051,918 B2
(45) Date of Patent: Aug. 21, 2018

(54) FOOTWEAR INCLUDING A TEXTILE UPPER

(71) Applicant: Under Armour, Inc., Baltimore, MD (US)

(72) Inventors: David Dombrow, Baltimore, MD (US); Kevin P. Fallon, Portland, OR (US); Thomas White, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 0 days.

(21) Appl. No.: 15/149,610

(22) Filed: May 9, 2016

(65) Prior Publication Data

US 2017/0020230 A1 Jan. 26, 2017

Related U.S. Application Data

(60) Provisional application No. 62/158,709, filed on May 8, 2015.

(51) Int. Cl.

| | |
|---|---|
| ***A43B 23/02*** | (2006.01) |
| ***A43C 1/04*** | (2006.01) |
| ***A43B 5/06*** | (2006.01) |
| ***A43B 7/08*** | (2006.01) |
| ***D04B 1/12*** | (2006.01) |
| ***D04B 1/22*** | (2006.01) |
| ***A43B 1/04*** | (2006.01) |

(Continued)

(52) U.S. Cl.

CPC ..... *A43B 23/028* (2013.01); *A43B 1/04* (2013.01); *A43B 5/06* (2013.01); *A43B 7/085* (2013.01); *A43B 23/0245* (2013.01); *A43B 23/088* (2013.01); *A43C 1/04* (2013.01); *A43C 5/00* (2013.01); *D04B 1/123* (2013.01); *D04B 1/22* (2013.01)

(58) Field of Classification Search

CPC ..... A43B 1/04; A43B 23/0245; D04B 1/22; D04B 1/24

USPC ..... 36/45

See application file for complete search history.

(56) References Cited

U.S. PATENT DOCUMENTS

| | | | |
|---|---|---|---|
| 625,331 | A | 5/1899 | Daut |
| RE18,804 | E | 4/1933 | Joha |
| 2,147,197 | A | 2/1939 | Glidden |

(Continued)

FOREIGN PATENT DOCUMENTS

| | | | |
|---|---|---|---|
| EP | 0632972 | B1 | 9/1996 |
| EP | 1130146 | A4 | 9/2004 |

(Continued)

OTHER PUBLICATIONS

Thermal Conductivity of some common Materials and Gases' (The Engineering Toolbox) Jan. 7, 2015 (Jan. 7, 2015) [online] retrieved from URL:https://web.archive.org/web/20150107151233/http://www.engineeringtoolbox.com/thermal-conductivity-d_429.html> pp. 2-3.

(Continued)

*Primary Examiner* — Ted Kavanaugh

(57) ABSTRACT

An article of footwear includes a sole structure and an upper attached to the sole structure. The upper is formed from a textile including interlocked strands oriented in a predetermined configuration. The strands include one or more inelastic strands operable to provide stretch and/or recovery properties to the upper.

20 Claims, 19 Drawing Sheets

(51) Int. Cl.
*A43B 23/08* (2006.01)
*A43C 5/00* (2006.01)

(56) References Cited

U.S. PATENT DOCUMENTS

| | | | | |
|---|---|---|---|---|
| 2,230,915 | A | 2/1941 | Spiro | |
| 2,314,098 | A | 3/1943 | McDonald | |
| 2,334,659 | A | 11/1943 | Van Arsdale et al. | |
| 2,335,210 | A | 11/1943 | Guinzberg | |
| 2,345,055 | A | 3/1944 | Lilley et al. | |
| 2,400,692 | A | 5/1946 | Herbert | |
| 2,440,393 | A | 4/1948 | Clark | |
| 2,467,237 | A | 4/1949 | Sherman et al. | |
| 2,495,984 | A | 1/1950 | Roy | |
| 2,538,673 | A | 1/1951 | Donahue | |
| 2,586,045 | A | 2/1952 | Hoza | |
| 2,636,287 | A | 4/1953 | Heilbronner | |
| 2,641,004 | A | 6/1953 | Whiting et al. | |
| 2,675,631 | A | 4/1954 | Doughty | |
| 2,679,117 | A | 5/1954 | Reed | |
| 3,093,916 | A | 6/1963 | Hiestand et al. | |
| 3,925,912 | A | 12/1975 | Martineau | |
| 4,232,458 | A | 11/1980 | Bartels | |
| 4,785,558 | A | 11/1988 | Shiomura | |
| 5,086,576 | A | 2/1992 | Lamson | |
| 5,345,638 | A | 9/1994 | Nishida | |
| 5,365,677 | A | 11/1994 | Dalhgren | |
| 5,784,806 | A | 7/1998 | Wendt | |
| 5,965,223 | A | 10/1999 | Andrews et al. | |
| 6,880,268 | B2 | 4/2005 | Chen | |
| 6,910,288 | B2 | 6/2005 | Dua | |
| 6,931,762 | B1 * | 8/2005 | Dua | A43B 1/04 12/142 G |
| 6,986,269 | B2 | 1/2006 | Dua | |
| 7,051,460 | B2 | 5/2006 | Orei et al. | |
| 7,131,296 | B2 | 11/2006 | Dua et al. | |
| 7,347,011 | B2 | 3/2008 | Dua et al. | |
| 7,637,032 | B2 | 12/2009 | Sokolowski et al. | |
| 7,774,956 | B2 | 8/2010 | Dua et al. | |
| 7,814,598 | B2 | 10/2010 | Dua et al. | |
| 8,028,440 | B2 | 10/2011 | Sokolowski et al. | |
| 8,042,288 | B2 | 10/2011 | Dua et al. | |
| 8,209,883 | B2 | 7/2012 | Lyden | |
| 8,266,749 | B2 | 9/2012 | Dua et al. | |
| 8,448,474 | B1 | 5/2013 | Tatler et al. | |
| 8,590,345 | B2 | 11/2013 | Sokolowski et al. | |
| 8,595,878 | B2 | 12/2013 | Huffa et al. | |
| 8,621,891 | B2 | 1/2014 | Dua et al. | |
| 8,650,916 | B2 | 2/2014 | Dua et al. | |
| 8,701,232 | B1 | 4/2014 | Droege et al. | |
| 8,800,172 | B2 | 8/2014 | Dua et al. | |
| 8,839,532 | B2 | 9/2014 | Huffa et al. | |
| 8,881,430 | B2 | 11/2014 | Seamarks et al. | |
| 8,950,088 | B2 | 2/2015 | Aveni et al. | |
| 8,959,959 | B1 | 2/2015 | Podhajny | |
| 8,973,288 | B2 | 3/2015 | Dojan et al. | |
| 8,973,410 | B1 | 3/2015 | Podhajny | |
| 8,997,529 | B1 | 4/2015 | Podhajny | |
| 9,032,763 | B2 | 5/2015 | Meir et al. | |
| 9,060,562 | B2 | 6/2015 | Meir et al. | |
| 9,149,086 | B2 | 10/2015 | Greene et al. | |
| 9,150,986 | B2 | 10/2015 | Dua et al. | |
| 9,192,204 | B1 | 11/2015 | Liles et al. | |
| 9,404,205 | B2 | 8/2016 | Meir | |
| 9,491,987 | B2 | 11/2016 | Antonelli et al. | |
| 9,510,637 | B2 | 12/2016 | Podhajny et al. | |
| 9,578,928 | B2 | 2/2017 | Farris | |
| 2009/0126231 | A1 | 5/2009 | Malmivaara | |
| 2013/0269212 | A1 * | 10/2013 | Little | A43B 1/04 36/84 |
| 2014/0137434 | A1 * | 5/2014 | Craig | A43B 1/04 36/54 |
| 2015/0013080 | A1 | 1/2015 | Thomas et al. | |
| 2015/0047227 | A1 | 2/2015 | Fallon et al. | |
| 2015/0059211 | A1 | 3/2015 | Droege et al. | |
| 2015/0107307 | A1 * | 4/2015 | Kosui | D04B 1/22 66/177 |
| 2016/0029736 | A1 * | 2/2016 | Meir | A43B 23/0245 36/9 R |
| 2016/0219966 | A1 * | 8/2016 | Podhajny | A43B 1/04 |
| 2016/0302527 | A1 * | 10/2016 | Meir | D04B 1/102 |
| 2017/0049187 | A1 * | 2/2017 | Aristizabal | D04B 1/24 |

FOREIGN PATENT DOCUMENTS

| | | | |
|---|---|---|---|
| EP | 2792260 | A3 | 12/2014 |
| EP | 2792264 | A3 | 12/2014 |
| EP | 2792265 | A3 | 12/2014 |
| EP | 2149629 | B1 | 1/2015 |
| GB | 0012787 | B2 | 6/1904 |

OTHER PUBLICATIONS

Written Opinion and International Search Report from Related PCT Application No. PCT/US16/031093 (dated Aug. 31, 2016).

* cited by examiner

FOOTWEAR INCLUDING A TEXTILE UPPER

CROSS REFERENCE TO RELATED APPLICATIONS

The present application claims priority to Provisional Application No. 62/158,709, filed 8 May 2015 and entitled "Footwear Including a Textile Upper." The disclosure of the aforementioned application is incorporated herein by reference in its entirety.

FIELD OF THE INVENTION

The present invention relates to an article of footwear and, in particular, footwear including a knit upper with curving structures.

BACKGROUND

Articles of footwear typically include an upper and a sole structure attached to the upper. When the upper is knitted, it is conventionally knitted has a flat, U-shaped template. The ends of the U are brought together and sewn, generating a stitch/seam line along the heel. Stitch lines contact the foot of the user, creating discomfort via friction. Accordingly, it would be desirable to provide a knit upper with a stitchless and/or seamless heel.

SUMMARY OF THE INVENTION

An article of footwear includes a sole structure and an upper attached to the sole structure. The upper is formed from a textile including strands oriented in a predetermined configuration and interlocked via knitting. The knit configuration further includes truncated rows operable to generate a curved structure within the upper.

BRIEF DESCRIPTION OF THE DRAWINGS

Like reference numerals have been used to identify like elements throughout this disclosure.

DETAILED DESCRIPTION

Figure 1:
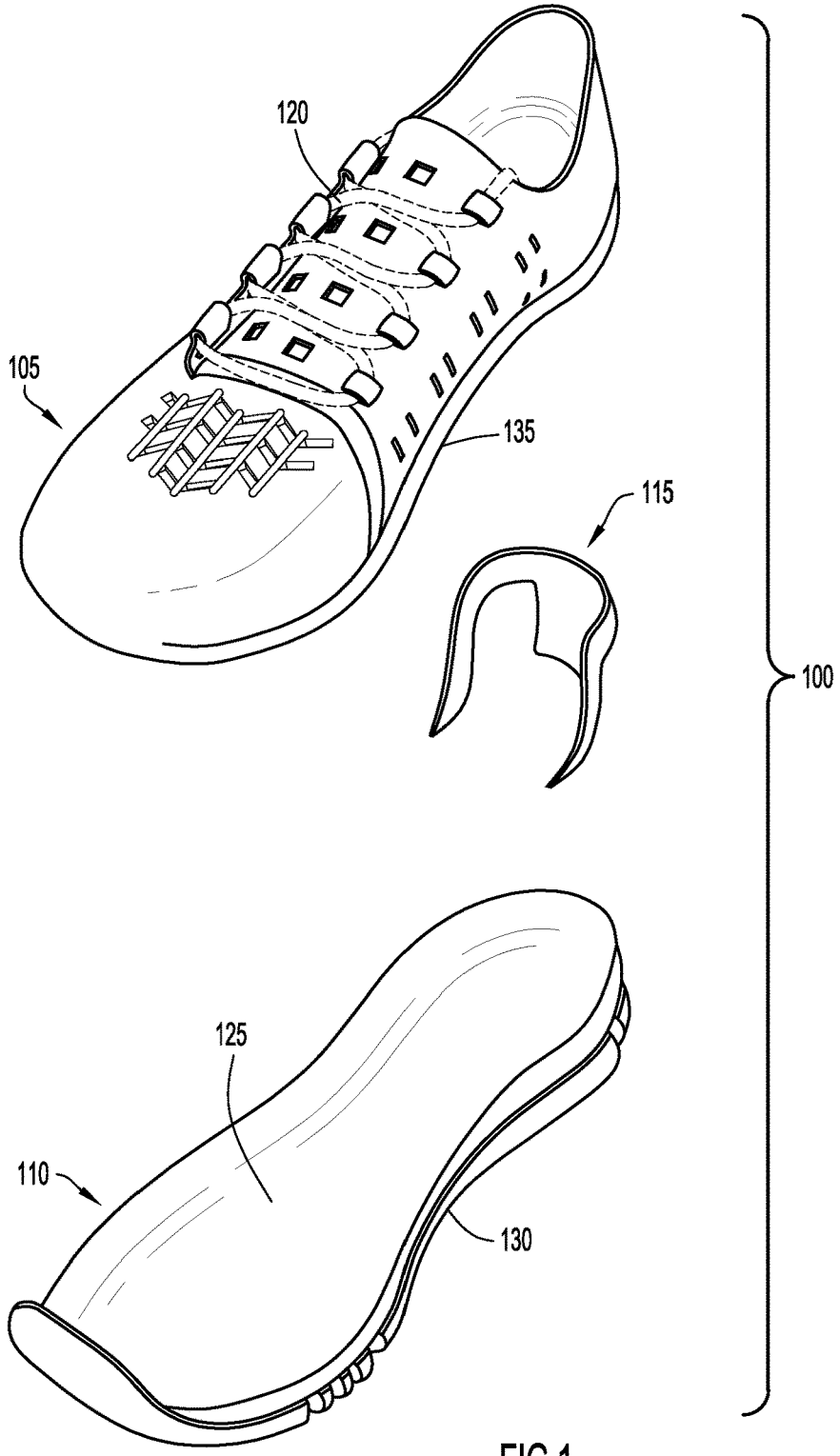
FIG. 1 is an exploded view of an article of footwear in accordance with an embodiment of the invention (footwear configured for a right foot).
Figure 2A:
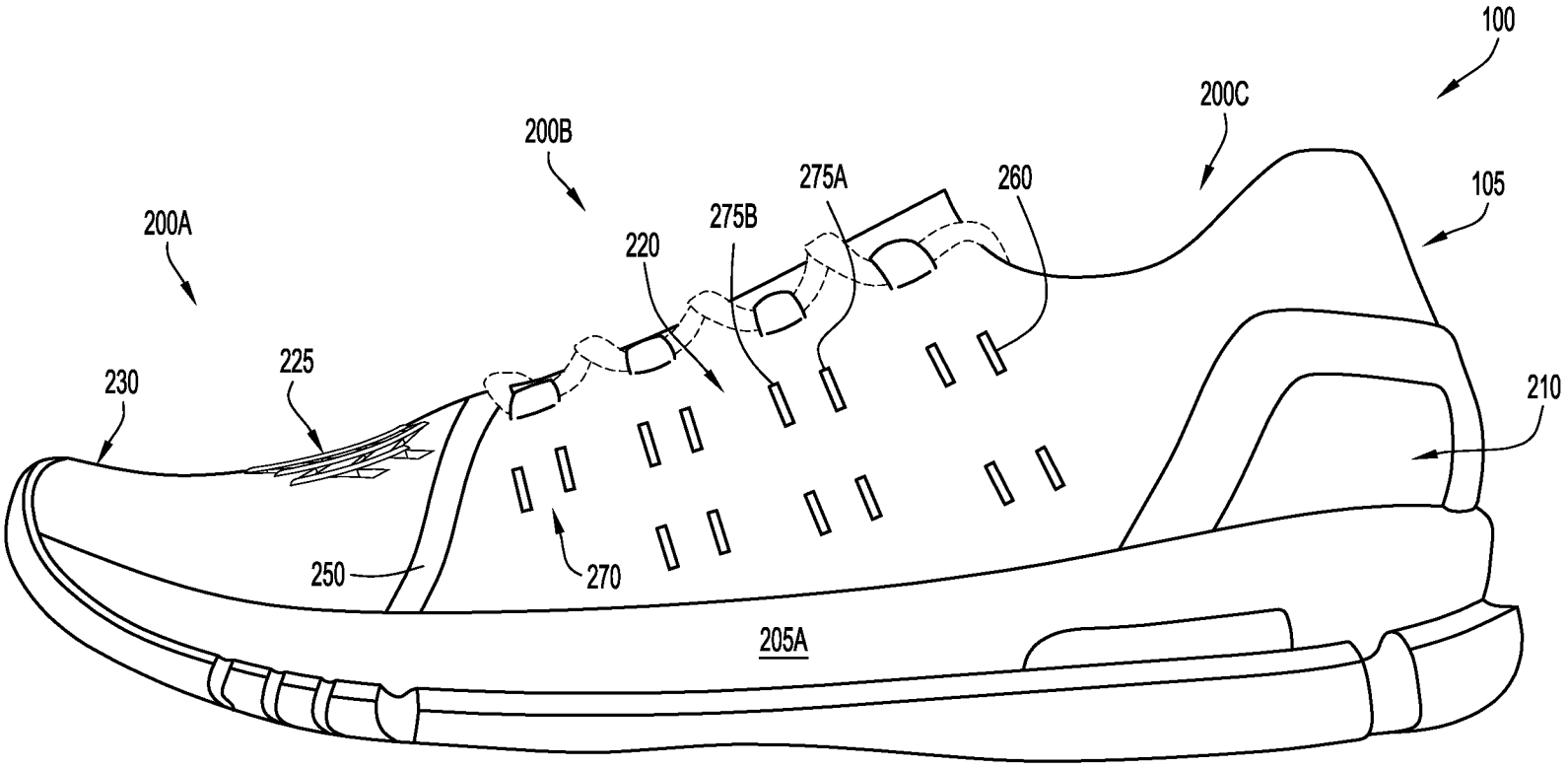
FIG. 2A is side view in elevation of the article of footwear shown in FIG. 1, showing the medial footwear side.
Figure 2B:
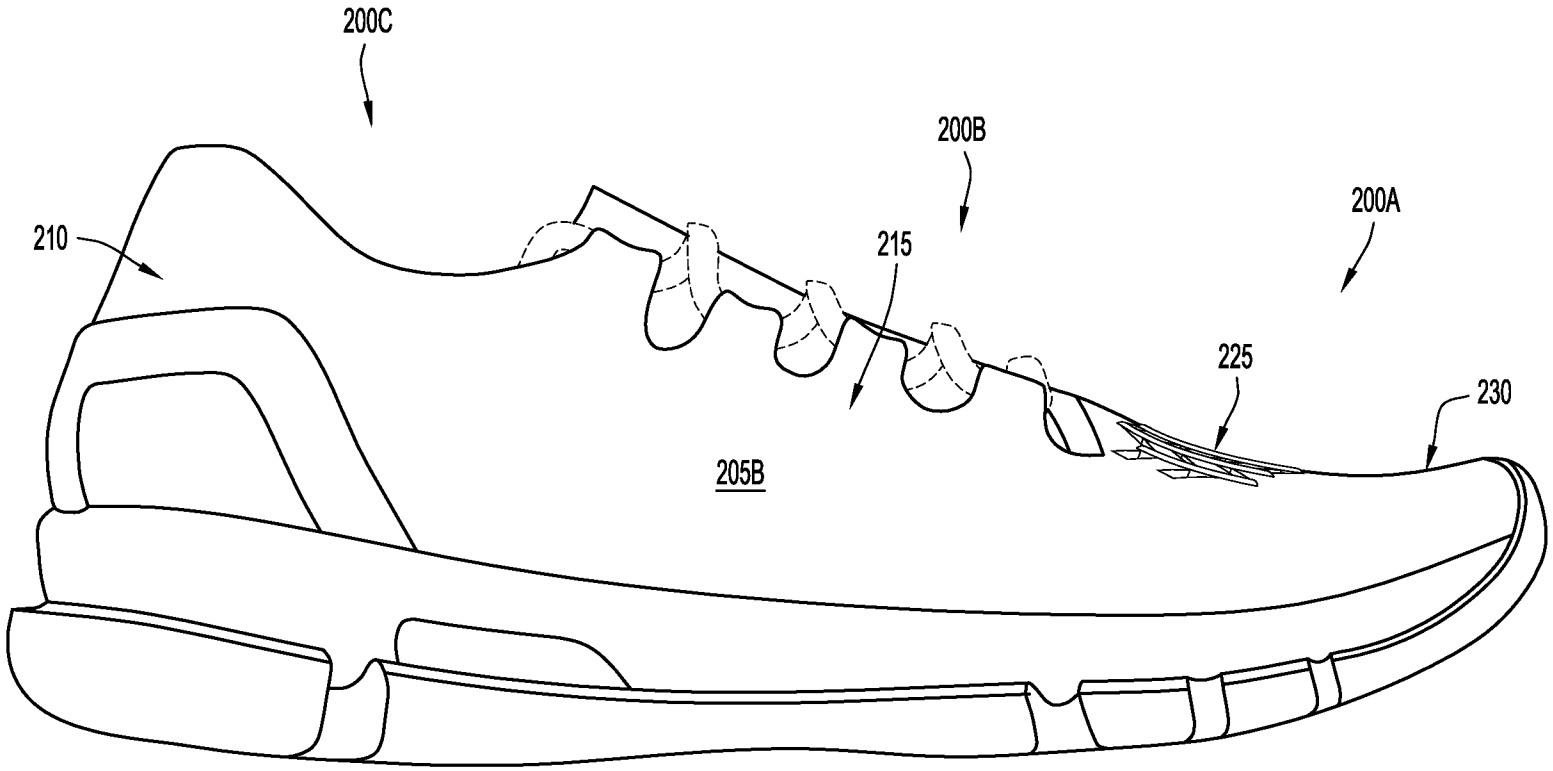
FIG. 2B is a side view in elevation of the article of footwear shown in FIG. 1, showing the lateral footwear side.
Figure 2C:
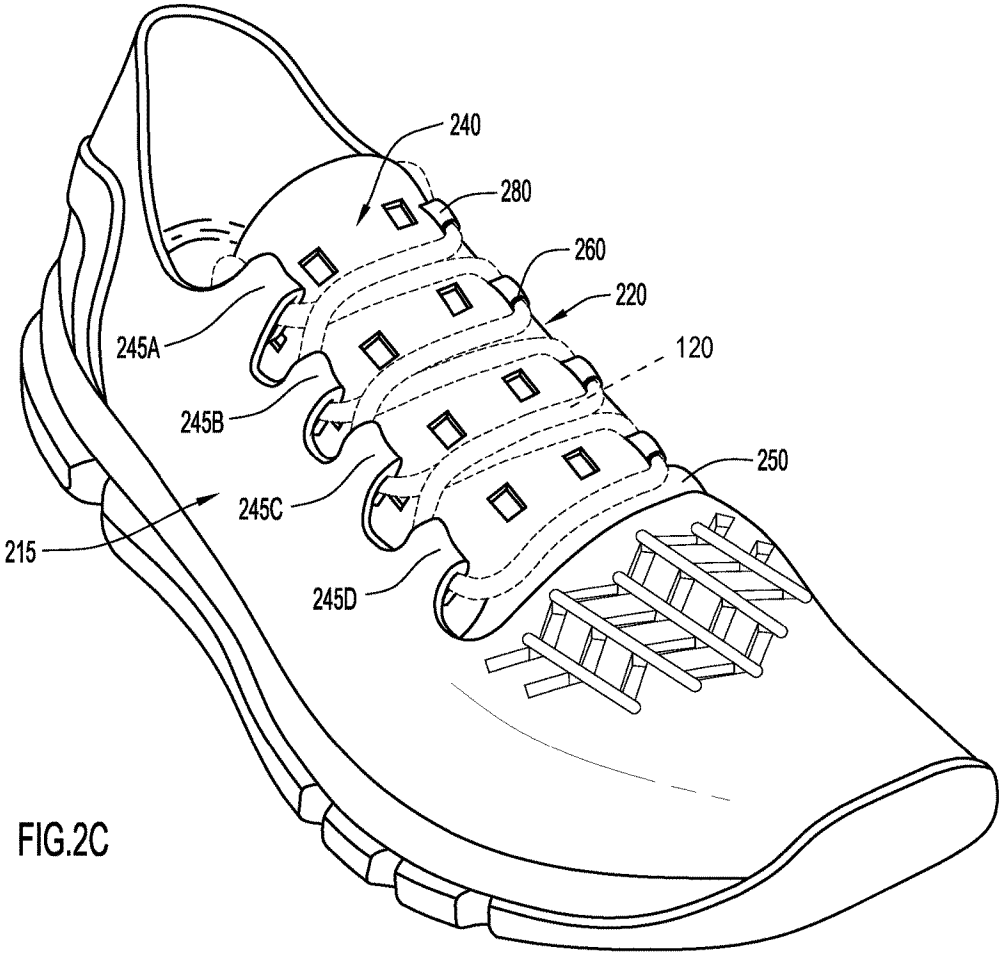
FIG. 2C is a front perspective view of the article of footwear of FIG. 1, showing the lateral footwear side.
Figure 2D:
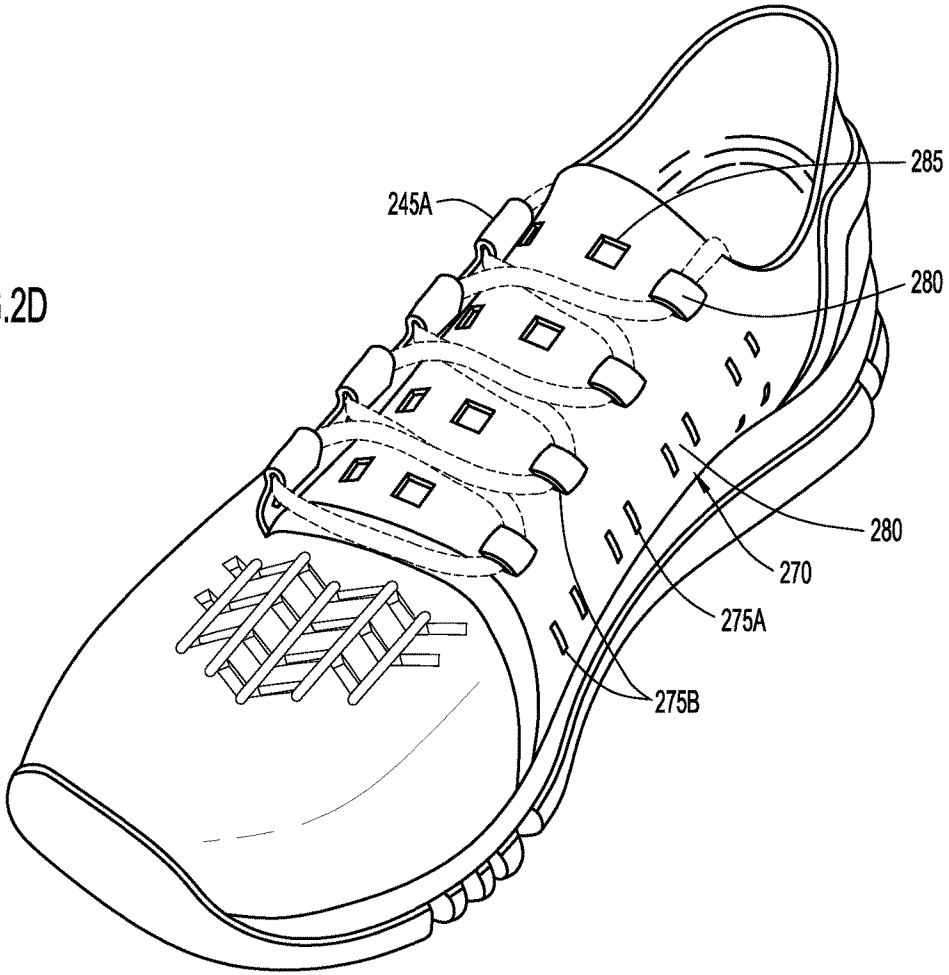
FIG. 2D is a front perspective view of the article of footwear shown in FIG. 1, showing the medial footwear side.
Figure 2E:
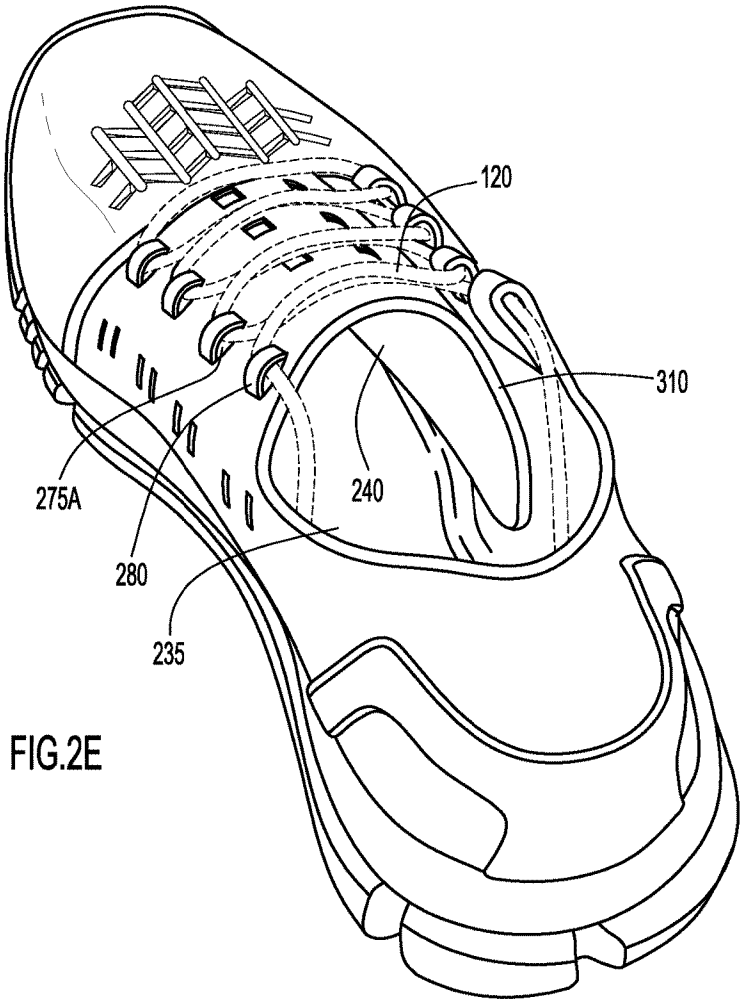
FIG. 2E is a rear perspective view of the article of footwear shown in FIG. 1, showing the medial footwear side.
Figure 3:
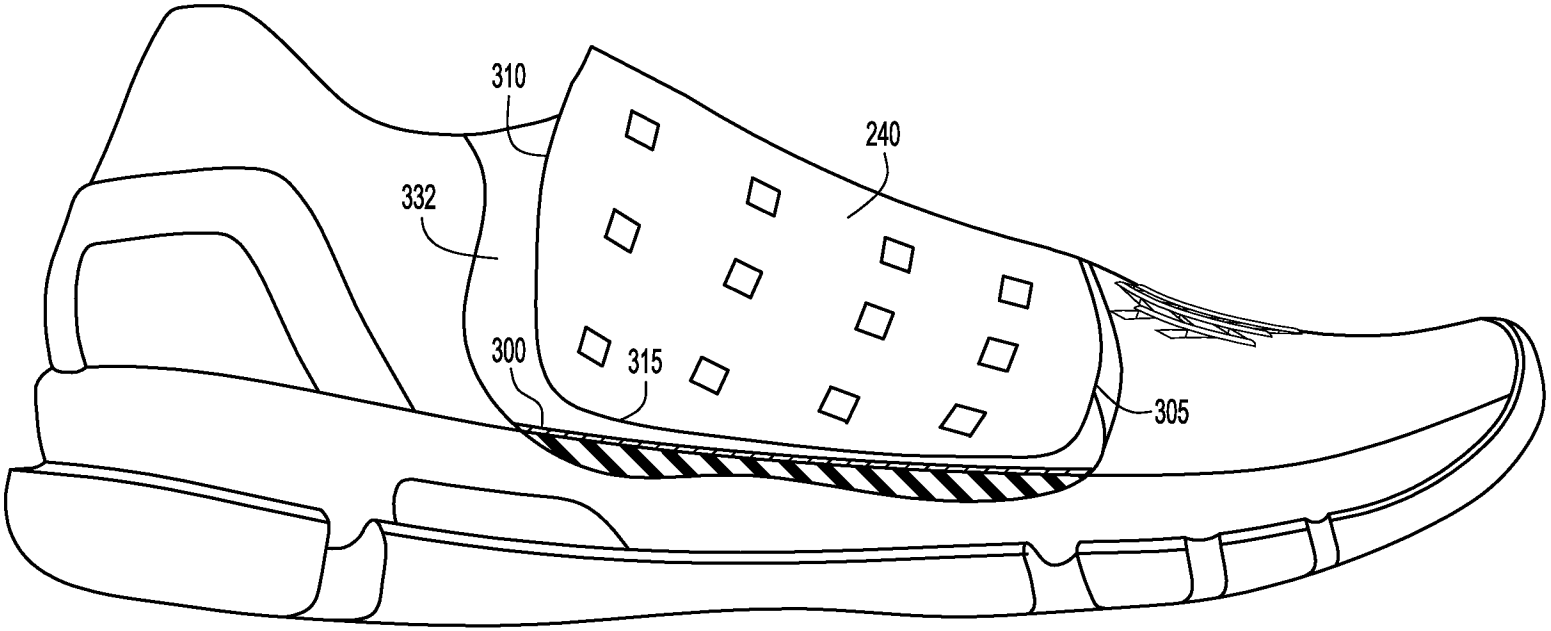
FIG. 3 is a side view in elevation of the article of footwear shown in FIG. 1, showing the lateral footwear side and further including a partial cut-out section.

As described herein with reference to the example embodiment of FIGS. 1-3, an article of footwear 100 includes an upper 105 coupled to a sole structure 110 and further including a heel counter 115 and a fastening element or fastener 120 (e.g., a lace or cord, which is shown in phantom). The article of footwear 100 is an athletic shoe (e.g., a running shoe) defining a forefoot region 200A, a midfoot region 200B, and a hindfoot region 200C, as well as a medial side 205A and a lateral side 205B. The forefoot region 200A generally aligns with the ball and toes of the foot, the midfoot region 200B generally aligns with the arch and instep areas of the foot, and the hindfoot region 200C generally aligns with the heel and ankle areas of the foot. Additionally, the medial side 205A is oriented along the medial (big toe) side of the foot, while the lateral side 205B is oriented along the lateral (little toe) side of the foot.

The upper 105 includes and/or defines a plurality of sections that cooperate to define the foot cavity. A heel section 210 includes heel cup configured to align with and cover the calcaneus area of a human foot. A lateral quarter section 215, disposed forward the heel section 210, is oriented on the lateral shoe side 205B. Similarly, a medial quarter section 220, disposed forward the heel section 210, is oriented on the medial shoe side 205A. A vamp section 225 is disposed forward the quarter sections 215, 225; moreover, a toe cage section 230 is disposed forward the vamp section. The upper 105 may further include an instep cover section 240 configured to align and span the instep area of the foot as well as a planum section or footbed 300 (FIG. 3) that engages the planum (bottom) of the foot. With this configuration, the heel 210, lateral quarter 215, medial quarter 220, vamp 225, toe cage 230 and planum 300 sections cooperate to form a foot cavity 332 (FIG. 3) into which a human foot is inserted by way of an access opening 235 formed cooperatively by the heel 210, the lateral 215 and medial 220 quarters, and the instep cover 240.

Referring to FIG. 2C, the lateral quarter section 215 extends from the heel section 210 to the vamp section 225, traveling upward from the planum section 300 such that the lateral quarter spans the lateral side of the foot, proximate the hindfoot and midfoot areas. The lateral quarter 215 may be formed integrally with the heel section 210, the vamp section 225, and the planum section 300. The lateral quarter 215 is adapted to receive a fastener such as a shoe lace. In an embodiment, the lateral quarter 215 includes a plurality of looped sections 245A, 245B, 245C, 245D disposed at the lateral quarter distal edge (upper edge). As illustrated, the looped sections 245A-245D are linearly spaced, being generally aligned in an array extending longitudinally along the shoe 100. In this manner, each looped section 245A-245D is configured to receive the fastener 120 (the shoe lace), movably capturing the fastener therein. The looped sections 245A-245D, moreover, cooperate with one or more elements disposed on the instep cover 240 to engage the fastener 120 (shown in phantom) to secure the shoe 100 to the foot of the wearer.

Referring to FIGS. 2D and 2E, the medial quarter 220 extends from the heel 210 to the vamp 225, traveling upward from the planum 300 such that the medial quarter spans the medial side of the foot, proximate the hindfoot and midfoot areas. The medial quarter 220 may be seamlessly and/or stitchlessly integrated with each of the heel 210, vamp, and planum 300 sections of the upper 105.

The instep cover 240 is configured to span the dorsum portion of the midfoot (i.e., the instep). The instep cover 240 may be formed integrally (stitchlessly and/or seamlessly) with the medial quarter section 220. As best seen in FIG. 3, the instep cover 240 defines a forward edge 305 (oriented toward the vamp 225) and a rearward edge 310 oriented generally parallel to the forward edge. The instep cover 240 further defines distal edge 315 oriented generally orthogonal to the forward and rearward edges. The instep cover 240 generally spans the instep of the foot, extending from the medial shoe side 205A to the lateral shoe side 205B, and extending from the throat line 250 of the vamp 225 at its forward edge 305 to the access opening 235 at its rearward edge 310. As noted above, the access opening 235 is partially defined by the rearward edge 310.

The instep cover 240 may include one or more narrow, elongated openings or slots 260 operable to permit passage of the fastener 120 therethrough. The instep cover 240 may also include additional openings or windows 285 operable to improve airflow into/out of the upper.

The forefoot region 200A of the upper 105 includes the vamp section 225, which extends forward from the lateral 215 and medial 220 quarters, being formed integrally therewith. The vamp section 225 includes the throat line 250 within its proximal region and toe cage 230 within its distal region, the toe cage being configured to span the toes of the foot.

In an embodiment, the upper 105 (or one or more sections) is a textile formed via knitting. Knitting is a process for constructing fabric by interlocking a series of loops (bights) of one or more strands organized in wales and courses. In general, knitting includes warp knitting and weft knitting. In warp knitting, a plurality of strands runs lengthwise in the fabric to make all the loops. In weft knitting, one continuous strand runs crosswise in the fabric, making all of the loops in one course. Weft knitting includes fabrics formed on both circular knitting and flat knitting machines. With circular knitting machines, the fabric is produced in the form of a tube, with the threads running continuously around the fabric. With a flat knitting machine, the fabric is produced in flat form, the strands/loops alternating back and forth across the fabric. In an embodiment, the upper 105 is formed via flat knitting utilizing stitches including, but not limited to, a plain stitch; a rib stitch, a purl stitch; a missed or float stitch (to produce a float of yarn on the fabric's wrong side); and a tuck stitch (to create an open space in the fabric). The resulting textile includes an interior side (the technical back) and an exterior side (the technical face), each layer being formed of the same or varying strands and/or stitches. By way of example, the textile may be a single knit/jersey fabric, a double knit/jersey fabric, and/or a plated fabric (with yarns of different properties are disposed on the face and back). In a specific embodiment, the textile is a double knit fabric formed via a flat knitting process. An exemplary knitting capable of forming the upper 105 includes the CMS 730 S or the CMS 530 H, both available from H. Stoll GmbH & Co. KG, Stollweg 1, Reutlingen, Del.

Utilizing knitting, the entire upper 105 (or selected sections) may be configured as a unitary structure (i.e., it may possess a unibody construction) to minimize the number of seams utilized to form the shape of the upper. For example, the upper 105 may be formed as a one-piece template, each template portion being integral with adjacent template portions. Accordingly, each section 210, 215, 220, 225, 230, 240, 300 of the upper 105 may include a common strand interconnecting that section with adjacent sections (i.e., the common strand spans both sections). In addition, the connection between adjacent sections may be stitchless and seamless. By stitchless and/or seamless, it is meant that adjacent sections are continuous or integral with each other, including no edges that require joining by stitches, tape, adhesive, welding (fusing), etc.

Figure 4A:
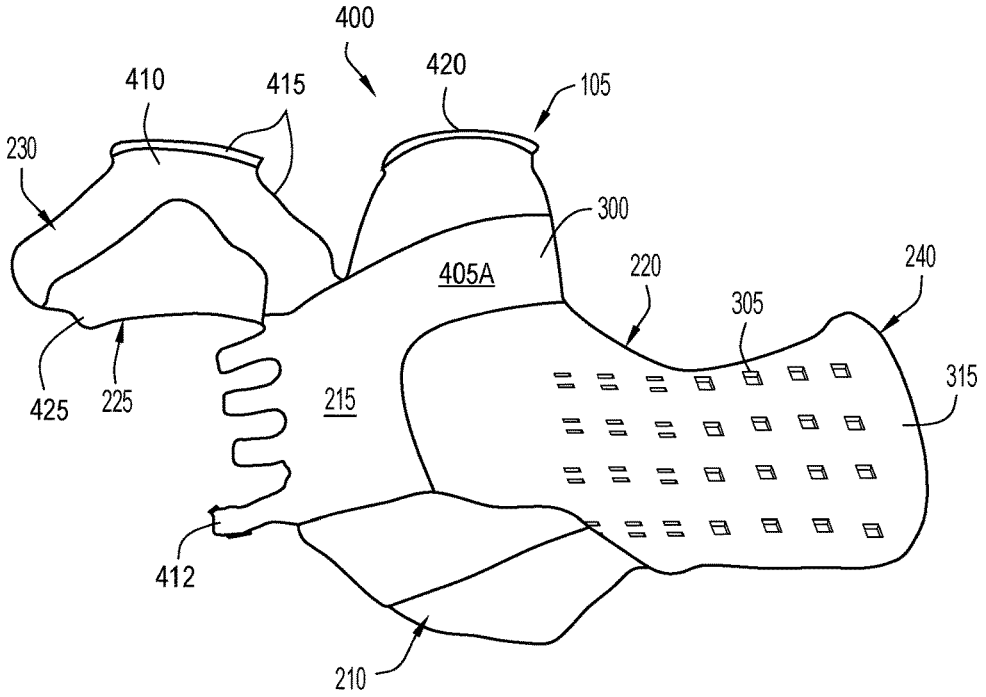
FIG. 4A is a top view of a template for forming the upper of FIG. 1, showing the interior side of the template.
Figure 4B:
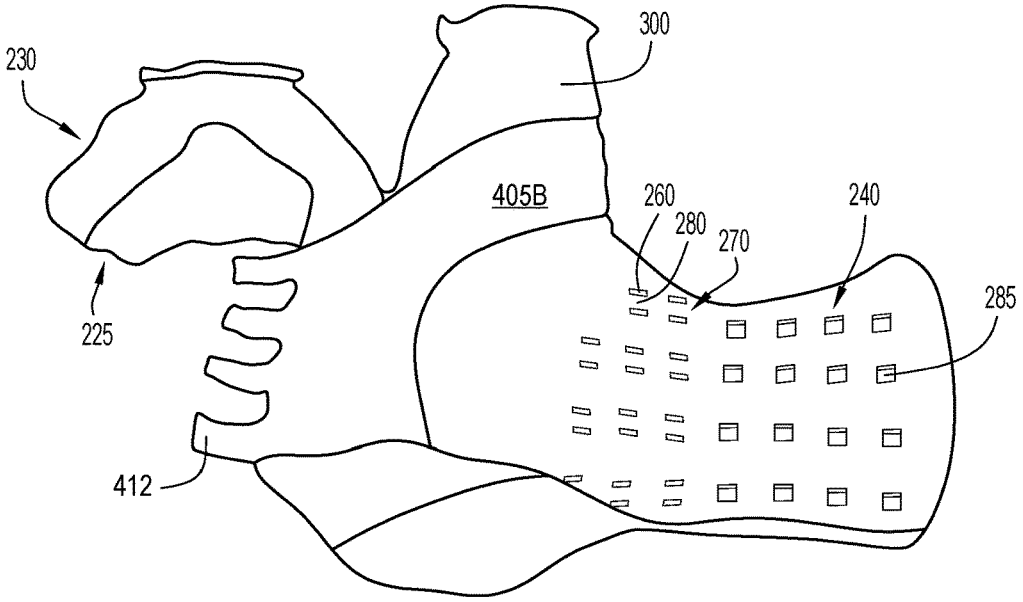
FIG. 4B is a top view of a template for forming the upper of FIG. 1, showing the exterior side of the template.

Referring to FIGS. 4A and 4B, in operation, a flat knitting process (e.g., a Jacquard flat knitting process) can be utilized to form a template 400 having a unitary or unibody construction. As shown, the template 400, which defines an interior (wearer-facing) side 405A and an exterior side 705B, includes sections formed integrally and/or seamlessly/stitchlessly with adjacent sections. In addition, the template defines planar and non-planar or contoured areas. Planar areas define generally flat areas of the template 700, while non-planar areas are three-dimensional, e.g., these areas possess an arcuate cross section, curving in a predetermined direction. By way of specific example, the planar areas of the template include the planum section 300, the medial quarter 220 with instep cover 240, and the lateral quarter 215 with linear segments or strips 712 which form the looped sections 245A-245D. The non-planar areas of the template 700 includes some or all of the portions forming the heel cup 400 and, optionally, the some or all of the forward portion of the toe cage 230.

Figure 5A:
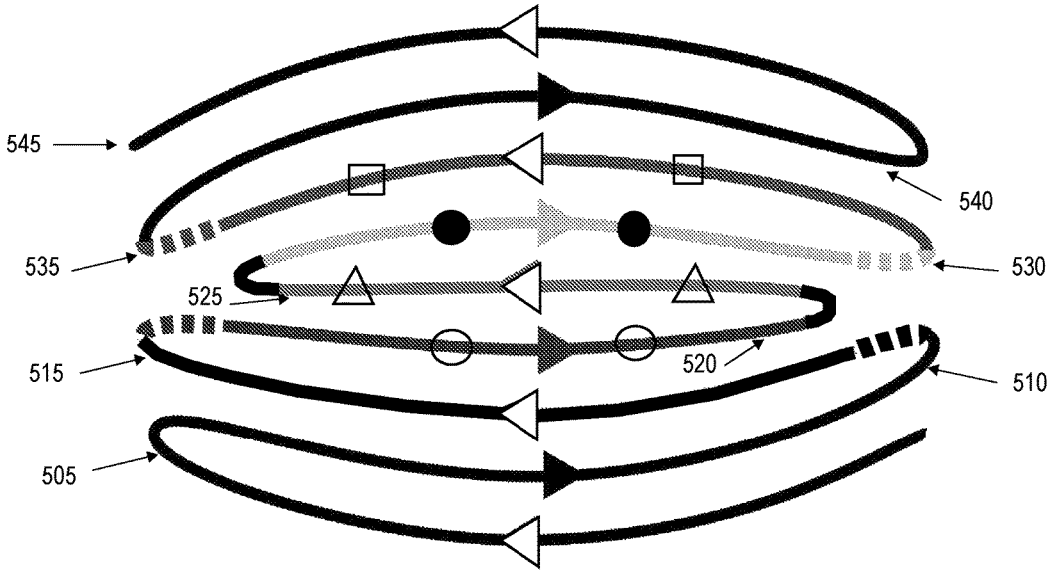
FIG. 5A is a schematic representing course length organization within a knit structure, showing courses of varying lengths.
Figure 5B:
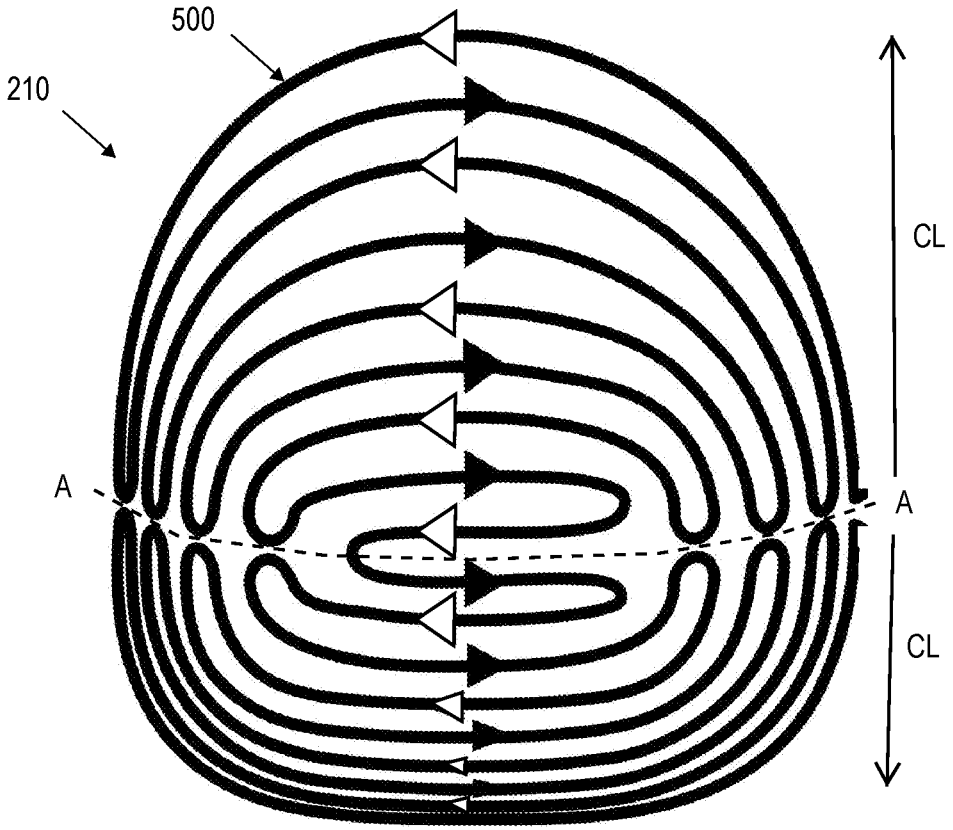
FIG. 5B is a schematic representing course length organization within a knit structure, showing courses of varying lengths.
Figure 6A:
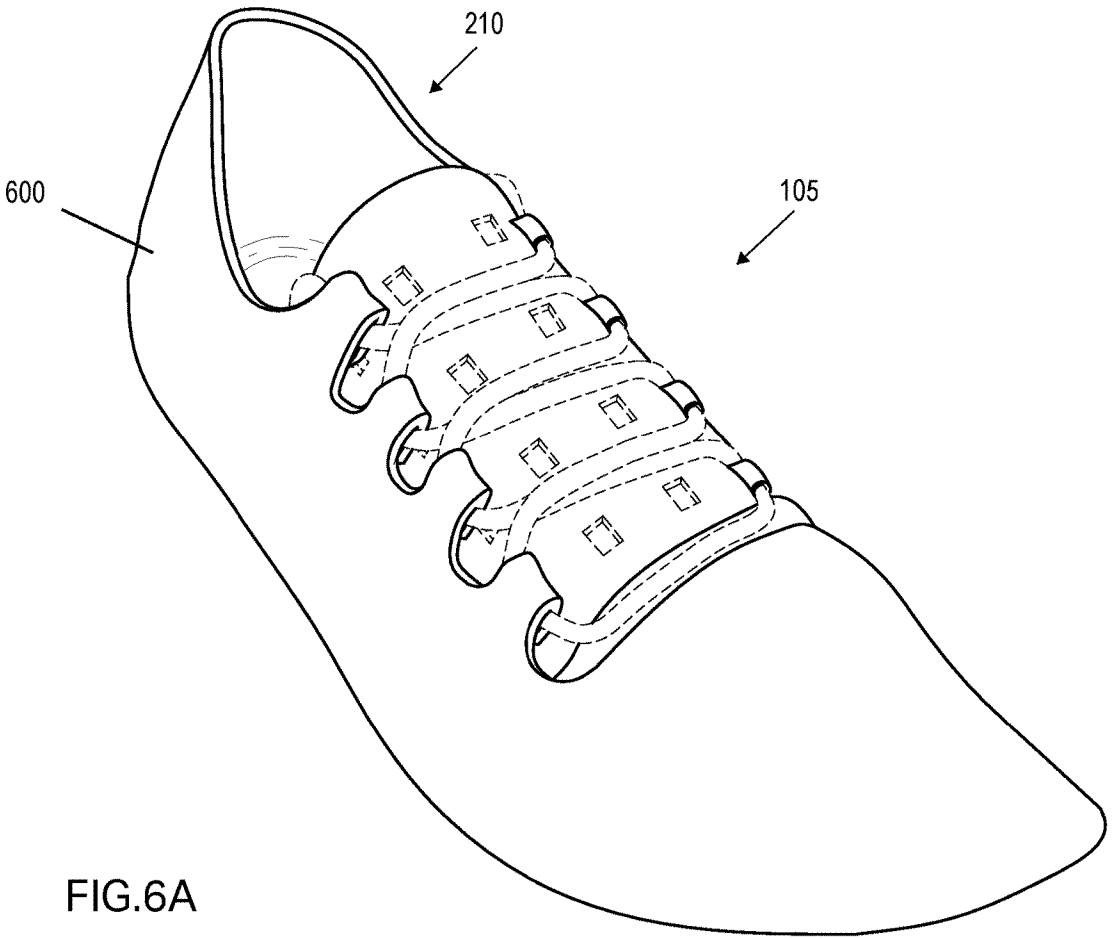
FIG. 6A is an isolated view of the upper of the article of footwear of FIG. 1, showing a lateral side view in perspective.
Figure 6B:
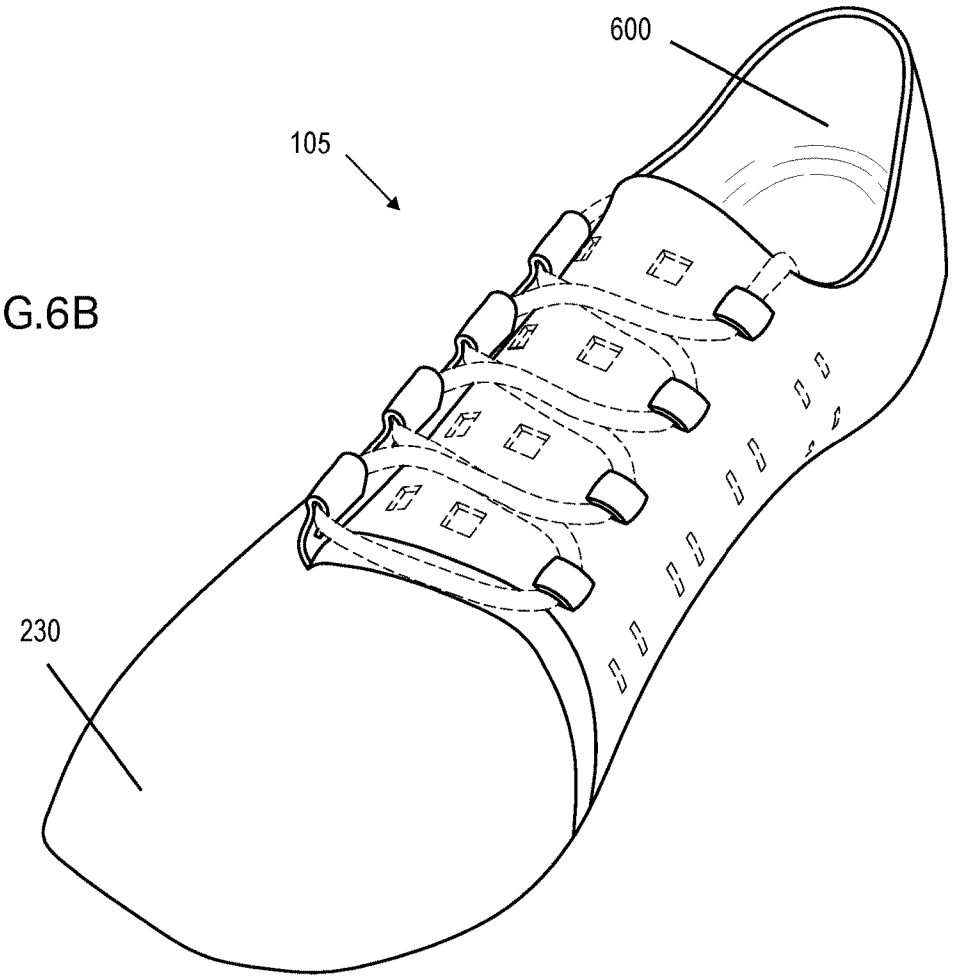
FIG. 6B is an isolated view of the upper of the article of footwear of FIG. 1, showing a medial side view in perspective.
Figure 6C:
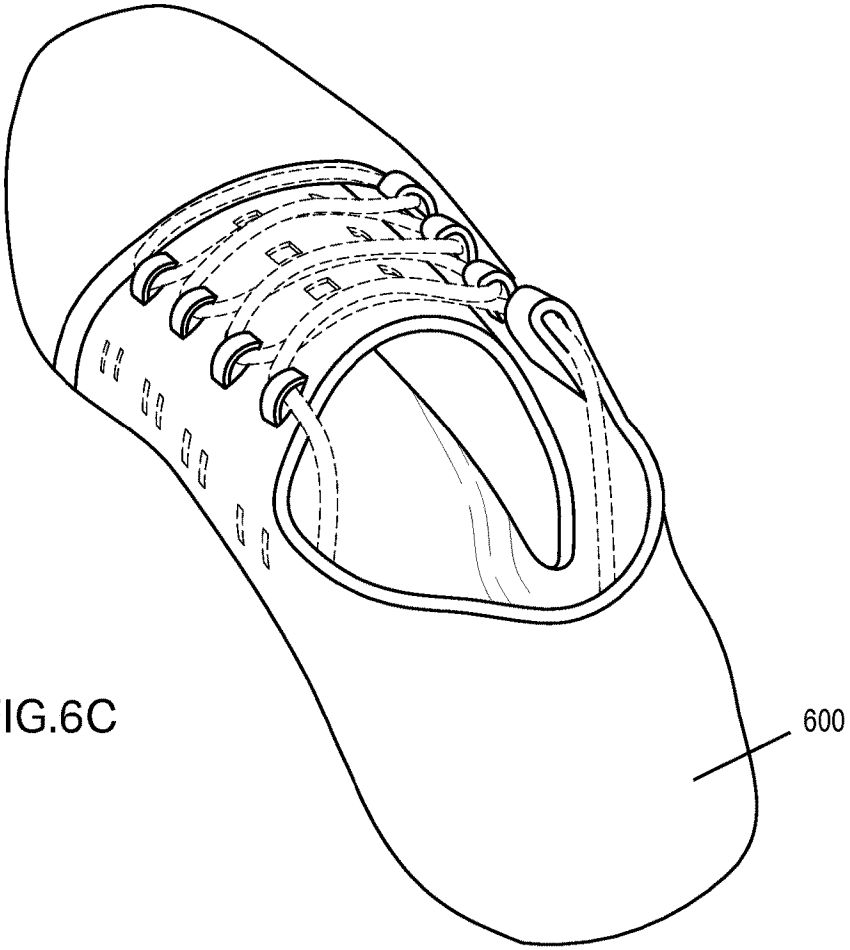
FIG. 6C is an isolated view of the upper of the article of footwear of FIG. 1, showing a rear medial view in perspective.
Figure 6D:
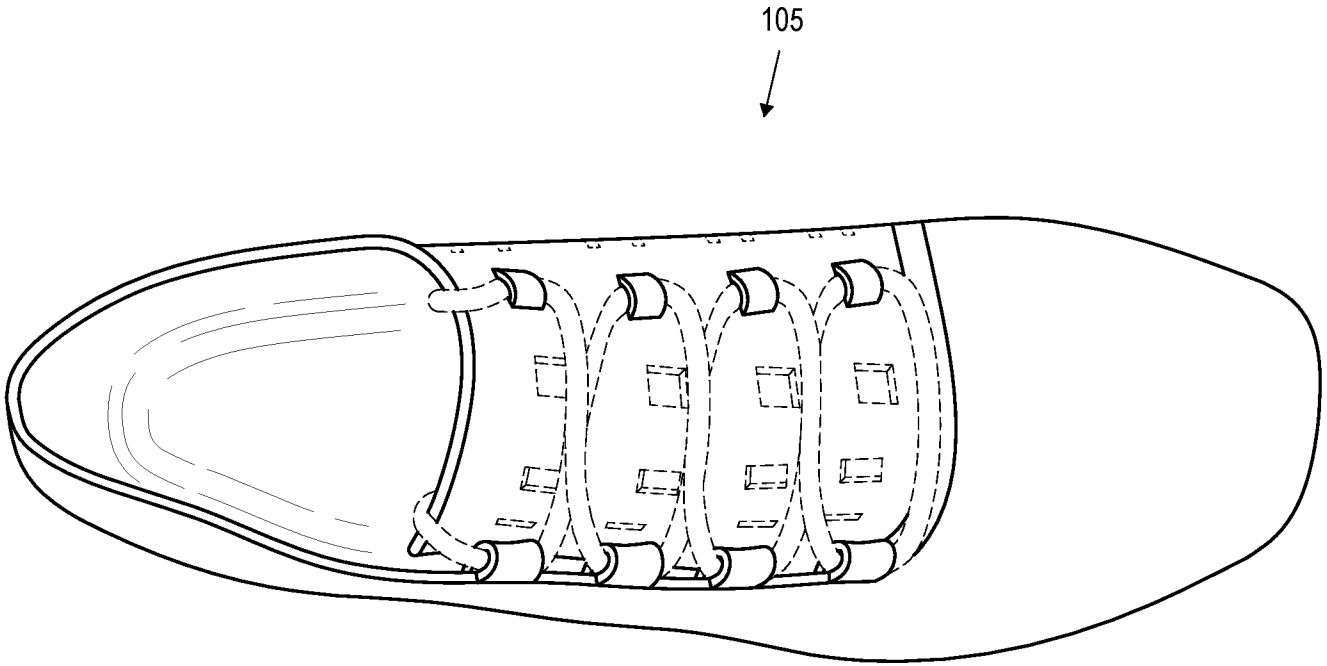
FIG. 6D is an isolated view of the upper of the article of footwear of FIG. 1, showing a top plan view.
Figure 6E:
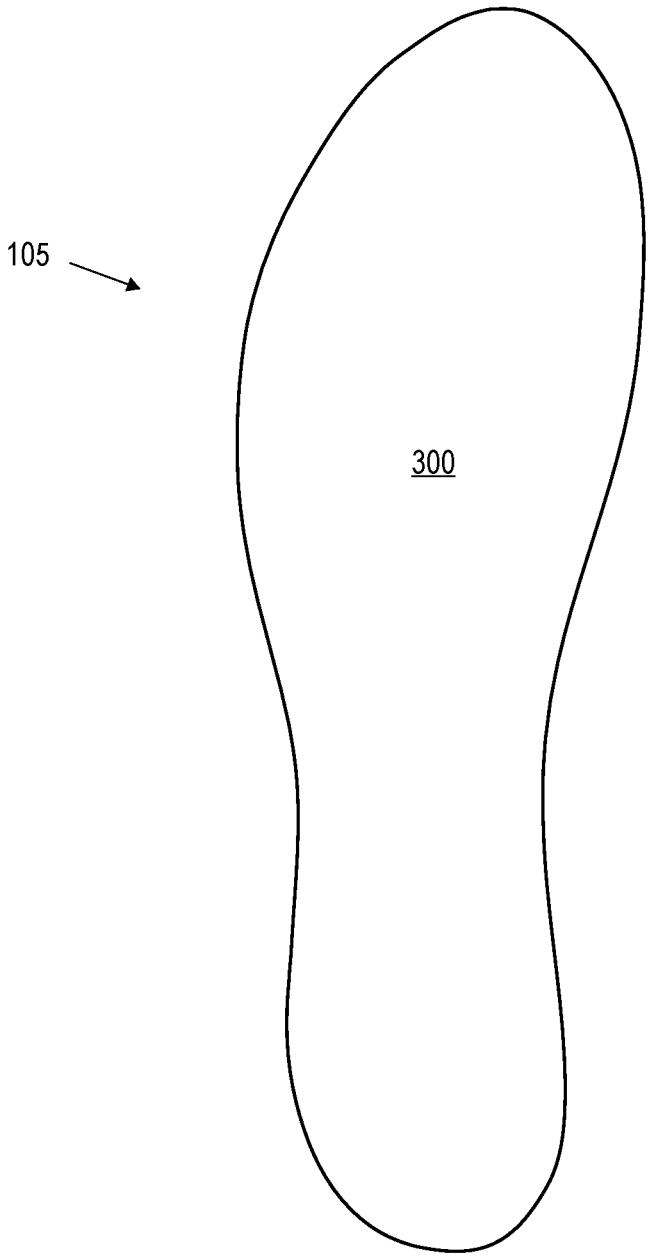
FIG. 6E is an isolated view of the upper of the article of footwear of FIG. 1, showing a bottom plan view.
Figure 6G:
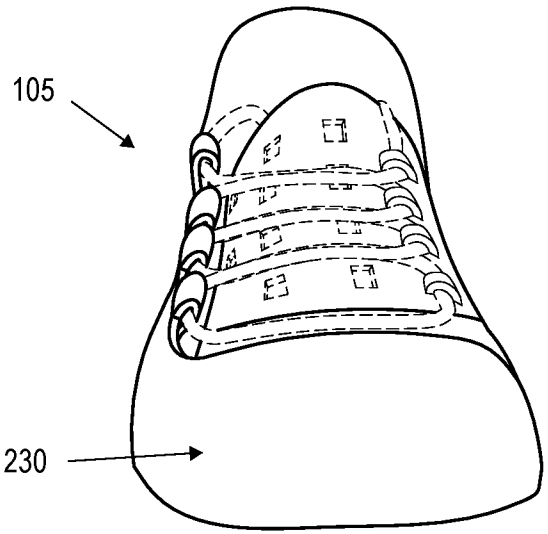
FIG. 6G is an isolated view of the upper of the article of footwear of FIG. 1, showing a rear elevated view.
Figure 6F:
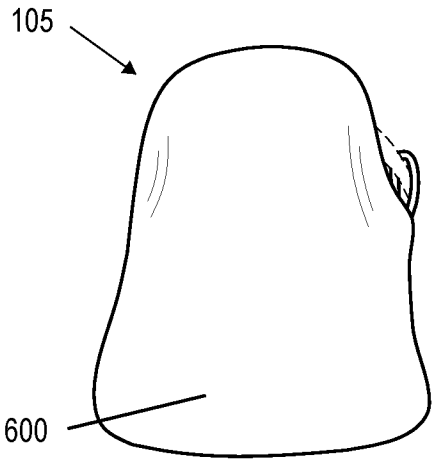
FIG. 6F is an isolated view of the upper of the article of footwear of FIG. 1, showing a front elevated view.
Figure 6H:
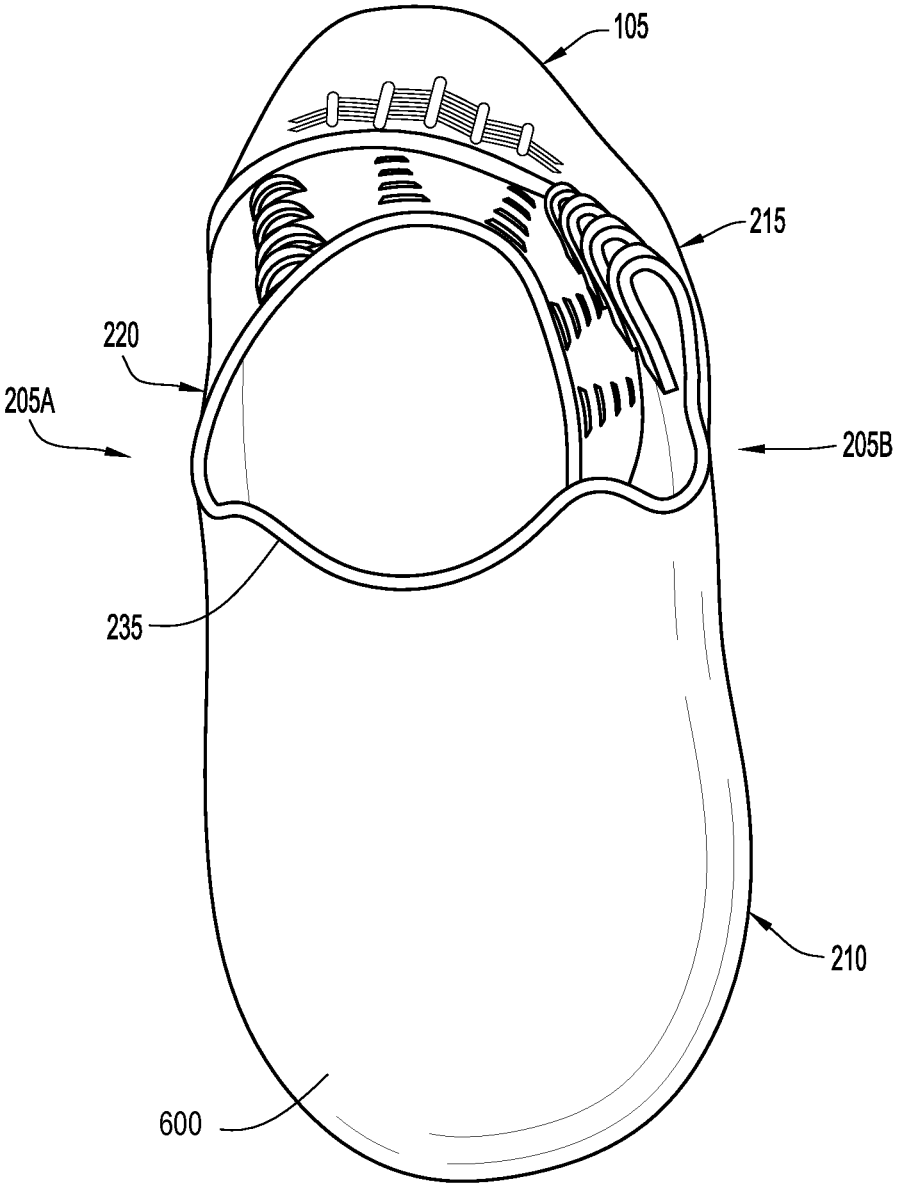
FIG. 6H is an isolated view of the upper of the article of footwear of FIG. 1, showing a rear view.

The non-planar areas are achieved through the selective placing of loops (or the selective omission of loops) within the textile structure. In an embodiment, the contoured or curved portion of the heel cup and/or toe cage is formed via course truncation. As explained above, a knit structure includes strands with interlocked loops organized in wales and courses. The courses run horizontally within the structure, while the wales run vertically within the structure. In flat knitting, strands (and thus the loops) alternate back and forth across the fabric. Typically, the each course is worked laterally from a first lateral edge to a second lateral edge. Referring to FIG. 5, the knit structure 500 includes a plurality of courses 505, 510, 520, 525, 530, 535, 540, 545 disposed in the technical face or technical back of the knit structure. Courses 505, 510, 515, 540, and 545 are full courses, extending from first edge of the structure 500 to the second edge of the structure. In contrast, courses 520, 525, 530, and 535 are truncated courses. That is, the course does not span all the way from the first edge to the second edge. The direction and amount of truncation is not particularly limited. For example, courses 520 and 530 are partially truncated, being truncated on the right and left sides, respectively. Course 535 is fully truncated, being shortened on its left and right sides. The portion of a course extending beyond an adjacent course (illustrated in phantom) must interlocked with a non-adjacent course. For example, portions of course 535 must interlock with course 525. Similarly, course 530 must interlock with course 515.

In this manner, truncation of the courses generates distortion in the knit construction 500. Specifically, contours or curvatures result, with fully truncated rows generate outward curvature in the flat knit construction 500. Accordingly, the knit construction 500 may nest short rows of various lengths to generate a desired contour the knit structure 500. For example, defining a horizontal, heel axis and then organizing courses such that the greatest degree of truncation occurs proximate the axis, with course length gradually increasing in a direction away from the axis (indicated by arrows CL). As seen best in FIG. 5B, the courses may be organized asymmetrically about the axis, with a higher number of courses being disposed above or below the axis (in FIG. 5B, more courses are disposed above the axis from the viewpoint of FIG. 5B). With this configuration, non-truncated or full courses are disposed on one or both sides of the truncated courses (e.g., full courses surround truncated courses).

As noted above, a flat knitting machine such as the Stoll CMS 730 S or the CMS 530 H, both available from H. Stoll GmbH & Co., Reutlingen, Del. may be utilized to form the planar and non-planar areas.

Referring back to FIGS. 4A and 4B, the upper 105 is assembled from the template 400 by folding the portion defining the toe cage 230 over onto the planum section 300 and securing (e.g., via stitching, adhesive, or any other suitable securing manner) the toe cage forward edge 415 to planum section forward edge 420 (the edges of the toe cage and forward planum edge are generally complementary). In addition, the medial quarter 220 is folded upward and the instep cover 240 wrapped in the transverse dimension to position the instep cover distal edge 315 along the inner side 405A of the lateral quarter 215. Once positioned, the forward edge 305 of the instep cover 240 is secured to vamp rearward edge 425. The looped sections 245A-245D, furthermore, are formed by folding over each of the linear segments 412 upon itself and securing (e.g., via stitching, adhesive or any other suitable securing manner) at its free edge (defining a seam at such connection). The resulting structure may then be heated (via steam) to shrink and/or set and/or fuse strands within the textile structure. Once set, the upper 105 may be secured to the sole structure 110 via, e.g., adhesive.

The resulting upper 105 is illustrated in FIGS. 6A-6H (the upper shown in isolation). As shown, the heel section 210 (formed via, e.g., the above course truncation process), is a seamless, stitchless structure defining a heel cup 600. The heel cup 600 possesses a generally arcuate profile. Specifically, the heel cup 600 is generally dome shaped, curving from a point proximate opening 235 toward the planum section 300, as well as curving from the lateral quarter 215 to the medial quarter 220 (and vice versa).

The lateral quarter section 215 and the medial quarter section 220 stitchlessly and seamlessly couple with the planum section 300. In conventional knit uppers, the heel section and planum section contain a seam resulting from the particular knit process utilized. Prior art uppers are generally formed via either circular knitting or flat knitting. In circular knitting, a large textile tube is formed such that the upper is a textile element forming a smaller portion of the tube wall that must be separated from the larger tube structure. Once removed, the textile element is generally planar, so the outer edges must be must be folded toward each other, overlapped, and secured together (via stitching, adhesive, etc.). Thus, while the textile element initially is flat, upon folding of the textile element and formation of the seams, an upper is formed that defines a void capable of receiving a foot. Seams are formed when joining the edges of the textile element. Specifically, a seam exists along the length of upper, extending along the planum section and the heel section.

In conventional flat knitting processes, the resulting template is again completely flat in the heel and/or planum sections. It is necessary to secure the edges together, requiring stitching along the heel and/or planum sections to form the upper. An example of this conventional upper formation is provided in, e.g., U.S. Pat. No. 7,347,011.

This is in contrast with the upper 105 of the present invention, which is seamless and stitchless along both the heel section 210 (including the heel cup 600) and the planum section 300, where the heel section 210 is seamlessly coupled with the planum section 300. This is the result of the heel cup 600 being a flat-knitted curve. The desired degree of curvature of the heel cup 600 may be any suitable for its described purpose (to receive the heel of the foot).

The strands forming the knitted textile (and thus the upper 105) may be any natural or synthetic strands suitable for their described purpose (i.e., to form a knit upper). The term "strand" includes one or more filaments organized into a fiber and/or an ordered assemblage of textile fibers having a high ratio of length to diameter and normally used as a unit (e.g., slivers, roving, single yarns, plies yarns, cords, braids, ropes, etc.). In a preferred embodiment, a strand is a yarn, i.e., a continuous strand of textile fibers, filaments, or material in a form suitable for knitting, weaving, or otherwise intertwining to form a textile fabric. A yarn may include a number of fibers twisted together (spun yarn); a number of filaments laid together without twist (a zero-twist yarn); a number of filaments laid together with a degree of twist; and a single filament with or without twist (a monofilament).

The strands may be heat sensitive strands such as flowable (fusible) strands and softening strands. Flowable strands are include polymers that possess a melting and/or glass transition point at which the solid polymer liquefies, generating viscous flow (i.e., becomes molten). In an embodiment, the melting and/or glass transition point of the flowable polymer may be approximately 80° C. to about 150° C. (e.g., 85° C.). Examples of flowable strands include thermoplastic materials such as polyurethanes (i.e., thermoplastic polyurethane or TPU), ethylene vinyl acetates, polyamides (e.g., low melt nylons), and polyesters (e.g., low melt polyester). Preferred examples of melting strands include TPU and polyester. As a strand becomes flowable, it surrounds adjacent strands. Upon cooling, the strands form a rigid interconnected structure that strengthens the textile and/or limits the movement of adjacent strands.

Softening strands are polymeric strands that possess a softening point (the temperature at which a material softens beyond some arbitrary softness). Many thermoplastic polymers do not have a defined point that marks the transition from solid to fluid. Instead, they become softer as temperature increases. The softening point is measured via the Vicat method (ISO 306 and ASTM D 1525), or via heat deflection test (HDT) (ISO 75 and ASTM D 648). In an embodiment, the softening point of the strand is from approximately 60° C. to approximately 90° C. When softened, the strands become tacky, adhering to adjacent stands. Once cooled, movement of the textile strands is restricted (i.e., the textile at that location stiffens).

One additional type of heat sensitive strand which may be utilized is a thermosetting strand. Thermosetting strands are generally flexible under ambient conditions, but become irreversibly inflexible upon heating.

The strands may also include heat insensitive strands. Heat insensitive strands are not sensitive to the processing temperatures experienced by the upper (e.g., during formation and/or use). Accordingly, heat insensitive strands possess a softening, glass transition, or melting point value greater than that of any softening or melting strands present in the textile structure and/or greater than the temperature ranges specified above.

The strand further includes strands formed of elastomeric material, i.e., and elastic strand. Elastic strands, by virtue of their composition alone, are capable of stretching under stress and recovery to its original size once the stress is released. Accordingly, elastic strands are utilized to provide a textile upper with stretch properties. An elastic strand is formed rubber or a synthetic polymer having properties of rubber. A specific example of an elastomeric material suitable for forming an elastic strand is an elastomeric polyester-polyurethane copolymer such as elastane, which is a manufactured fiber in which the fiber-forming substance is a long chain synthetic polymer composed of at least 85% of segmented polyurethane.

In contrast, an inelastic is formed of a non-elastomeric material. Accordingly, by virtue of composition alone, inelastic strands possess no inherent stretch and/or recovery properties. Hard yarns are examples of inelastic strands. Hard yarns include natural and/or synthetic spun staple yarns, natural and/or synthetic continuous filament yarns, and/or combinations thereof. By way of specific example, natural fibers include cellulosic fibers (e.g., cotton, bamboo) and protein fibers (e.g., wool, silk, and soybean). Synthetic fibers include polyester fibers (poly(ethylene terephthalate) fibers and poly(trimethylene terephthalate) fibers), polycaprolactam fibers, poly(hexamethylene adipamide) fibers, acrylic fibers, acetate fibers, rayon fibers, nylon fibers and combinations thereof.

In an embodiment, the upper 105 includes an inelastic strand possessing a topology that enables it to provide mechanical stretch and recovery within the knit structure. In an embodiment, the inelastic strand is a hard yarn texturized to generate stretch within the yarn. In a preferred embodiment, the inelastic strand is a bicomponent strand formed of two polymer components, each component possessing differing properties. The components may be organized in a sheath-core structure. Alternatively, the components—also called segments—may be oriented in a side-by-side (bilateral) relationship, being connected along the length of the strand. As seen in FIG. 6, the bicomponent strand 400 is a filament including a first polymer segment 405 and a second polymer segment 410. In the illustrated embodiment, the strand is eccentric, with the first polymer segment possessing more volume and/or mass than the second polymer segment 410. It should be understood, however, that the segments may be generally similar in dimensions (size, shape, volume, etc.).

In a further embodiment, the first segment of 405 is formed of a polymer possessing a first shrinkage rate (when exposed to wet or dry heat) and the second segment 410 is formed of a polymer possessing second shrinkage rate. Accordingly, when the strand 400 is exposed to heat, the component 405, 410 of the strand shrink at different rates, generating coils within the strand.

By way of example, the strand 400 is a polyester bicomponent strand. A polyester bicomponent strand is a continuous filament having a pair of polyesters connected side-by-side, along the length of the filament. Specifically, the polyester bicomponent strand 400 may include a poly(trimethylene terephthalate) and at least one polymer selected from the group consisting of poly(ethylene terephthalate), poly(trimethylene terephthalate), and poly(tetramethylene terephthalate) or a combination thereof. By way of example, the polyester bicomponent filaments include poly(ethylene terephthalate) and poly(trimethylene terephthalate) in a weight ratio of about 30/70 to about 70/30. In a preferred embodiment, the first polyester component 405 is a 2GT type polyester polyethylene terephthalate (PET) and the second polyester component 410 is a 3GT type polyester (e.g., polytrimethylene terephthalate (PTT)). In an embodiment, the 2GT type polyester forms about 60 wt % of the strand, while the 3GT type polyester forms about 40 wt % of the strand. As noted above, the strand 400 may be in the form of, without limitation, a single filament or a collection of filaments twisted into a yarn.

With the above configuration, when exposed to heat, the first polymer (polyester) segment 405 shrink/contracts at a different rate than the second polymer (polyester) segment 410. This, in turn, produces a regular, helical coil along the length of the strand 400. In an embodiment, the contraction value of each polymer segment 405, 410 may range from about 10% to about 80% (from its original diameter). The strand 400 may possess an after-heat-set crimp contraction value from about 30% to about 60%.

The helical coil of the strand 400 generates non-elastomeric, mechanical stretch and recovery properties within the strand (e.g., the filament or yarn). That is, the strand possesses mechanical stretch and recovery without the need to texturize the strand, which reduces strand durability. A bicomponent strand, moreover, possesses increased recovery properties compared to elastic strands at stretch levels of less than 25%. The recovery power of elastic strands increases with increasing stretch (e.g., 100% or more). Stated another way, the further an elastic strand is stretched, the better it recovers. At low stretch levels, elastic strands generate low recovery power. This is a disadvantage in footwear uppers, where the amount of stretch required during use is minimal (e.g., less than 25%).

The bicomponent strand 400 may possess any dimensions suitable for its described purpose. By way of example, the bicomponent strand 400 may be present within the textile as yarn having a denier of from about 70 denier to about 900 denier (78 dtex to 1000 dtex) and, in particular, from about 100 denier to about 450 denier.

The entire upper 105 or sections thereof may be formed completely of bicomponent strands 400. In an embodiment, the upper 105 is formed with a combination of bicomponent strands and non-bicomponent strands such as heat sensitive strands. The bicomponent strand 400 can be present from about 20% by weight to about 95% by weight (e.g., about 25%—about 75% by weight) based on the total weight of the textile structure (the entire upper 105 or sections thereof).

Stated another way, the ratio of the bicomponent strand 400 to other strands within the structure may be about 10:1 to about 1:10 (e.g., 1:1).

It should be understood that a strand may be categorized in a combination of the above categories. For example, a polyester yarn may be both a heat insensitive and an inelastic strand, as defined above.

Figure 7:
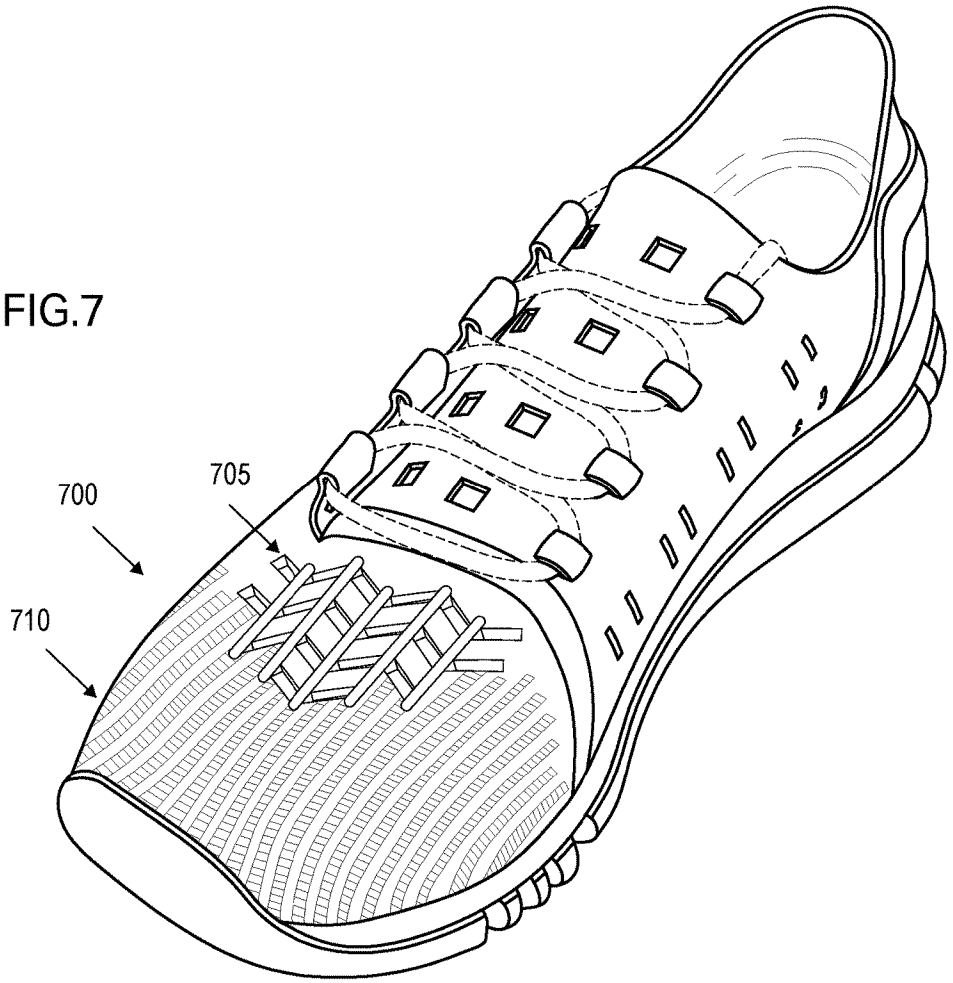
FIG. 7 is a perspective view of an article of footwear in accordance with an embodiment of the invention.

The vamp 225 may further include a microclimate modulation structure operable to affect movement of heat, air, and/or moisture (e.g., vapor) within the foot cavity 332. The temperature modulation structure includes strands selected to possess predetermined thermal conductivity values positioned at selected locations within the knit construction of the textile. Referring to FIG. 7, includes a first construction or portion 705 possessing a first knit construction and a second construction or portion 710 possessing a second knit construction. The first portion 705 forms the central area of the vamp 225, being oriented forward the throat line 250, with its lateral boundaries generally coextensive therewith, and its forward boundary located proximate the toe cage 230. The second portion 710 partially surrounds the first portion 705, being oriented along its forward, medial, and lateral sides. Stated another way, the second portion 710 forms the toe cage 230, the lateral side of the vamp 225, and the medial side of the vamp. As illustrated, the first portion 605 is integral with the second portion 710 with a seamless and/or stitchless transition therebetween. Each portion 705, 710 of the microclimate modulation structure 700 is independently capable of affecting the movement of heat, air, and/or moisture within the cavity and/or exhausting it from the foot cavity 332.

In an embodiment, the temperature modulation structure 700 includes first, high thermal conductivity strands and second, low thermal conductivity strands. High conductivity strands are strands that transfer heat along its length (axis) and/or width (transverse dimension) at a higher rate than low thermal conductivity strands. In an embodiment, high thermal conductivity strands are strands formed (e.g., entirely formed) of material possessing a thermal conductivity value greater than 0.40 W/m K. By way of example, the strands may be formed of high density polyethylene (HDPE, 0.45-0.52 @23 C) and/or ultra-high molecular weight polyethylene (UWMW-PE, 0.42-0.51 W/m K @23 C).

In a further embodiment, high thermal conductivity strand is a strand that possessing an axial thermal conductivity of at least 5 W/m K (e.g., at least 10 W/m K or at least 20 W/m K). The high thermal conductivity strand may be a multifilament fiber such as a gel-spun fiber. By way of specific example, the high conductivity strand is a gel-spun, multifilament fiber produced from ultra-high molecular weight polyethylene (UHMW-PE), which possesses a thermal conductivity value in the axial direction of 20 W/m K (DYNEEMA, available from DSM Dyneema, Stanley, N.C.).

The low thermal conductivity strand, in contrast, transfers heat along its length (axis) and/or width (transverse dimension) at a lower rate than that of the high thermal conductivity strand. In an embodiment, the low thermal conductivity strand is formed (e.g., entirely formed) of material possessing a thermal conductivity of no more than 0.40 W/m K. By way of example, the low conductivity strand may be formed of low density polyethylene (LDPE, 0.33 W/m K @23 C), nylon (e.g., nylon 6; nylon 6,6; or nylon 12) (0.23-0.28 W/m K @23° C.), polyester (0.15-0.24 W/m K @23° C.), and/or polypropylene (0.1-0.22 W/m K @23 C).

In another embodiment, the low thermal conductivity strand possesses an axial thermal conductivity (as measured along its axis) that is less than the axial conductivity of the high conductivity strands. By way of example, the low thermal conductivity strands possess an axial thermal conductivity value of less than 5 W/m K when high thermal conductivity strand possesses a thermal conductivity of greater than 5 W/m K; of less than 10 W/m K when high conductivity strand possesses a thermal conductivity of at least 10 W/m K; and/or less than 20 W/m K when high conductivity strand possesses a thermal conductivity of greater than 20 W/m K. Exemplary low thermal conductivity strands include strands formed of polyester staple fibers (axial thermal conductivity: 1.18 W/m K); polyester filament strands (axial thermal conductivity: 1.26 W/m K); nylon fiber strands (axial thermal conductivity: 1.43 W/m K); polypropylene fiber strands (axial thermal conductivity: 1.24 W/m K); cotton strands (axial thermal conductivity: 2.88 W/m K); wool strands (axial thermal conductivity: 0.48 W/m K); silk strands (axial thermal conductivity: 1.49 W/m K); rayon strands (axial thermal conductivity: 1.41-1.89 W/m K); and aramid strands (axial thermal conductivity: 3.05-4.74 W/m K), as well as combinations thereof.

The sole structure 110 comprises a durable, wear-resistant component configured to provide cushioning as the shoe 100 impacts the ground. In certain embodiments, the sole structure 110 may include a midsole and an outsole. In additional embodiments, the sole structure 110 can further include an insole that is disposed between the midsole and the upper 105 when the shoe 100 is assembled. In other embodiments, the sole structure 110 may be a unitary and/or one-piece structure. As can be seen, e.g., in the exploded view of FIG. 1, the sole structure 110 includes an upper facing side 125 and an opposing, ground-facing side 130. The upper facing side 125 may include a generally planar surface and a curved rim or wall that defines the sole perimeter for contacting the bottom surface 135 of the upper 105. The ground-facing side 130 of the sole structure 110 can also define a generally planar surface and can further be textured and/or include ground-engaging or traction elements (e.g., as part of the outsole of the sole structure) to enhance traction of the shoe 100 on different types of terrains and depending upon a particular purpose in which the shoe is to be implemented. The ground-facing side 130 of the sole structure 110 can also include one or more recesses formed therein, such as indentations or grooves extending in a lengthwise direction of the sole structure 110 and/or transverse the lengthwise direction of the sole structure, where the recesses can provide a number of enhanced properties for the sole structure (e.g., flexure/pivotal bending along grooves to enhance flexibility of the sole structure during use).

The sole structure 110 may be formed of a single material or may be formed of a plurality of materials. In example embodiments in which the sole structure includes a midsole and an outsole, the midsole may be formed of one or more materials including, without limitation, ethylene vinyl acetate (EVA), an EVA blended with one or more of an EVA modifier, a polyolefin block copolymer, and a triblock copolymer, and a polyether block amide. The outsole may be formed of one or more materials including, without limitation, elastomers (e.g., thermoplastic polyurethane), siloxanes, natural rubber, and synthetic rubber.

Figure 8:
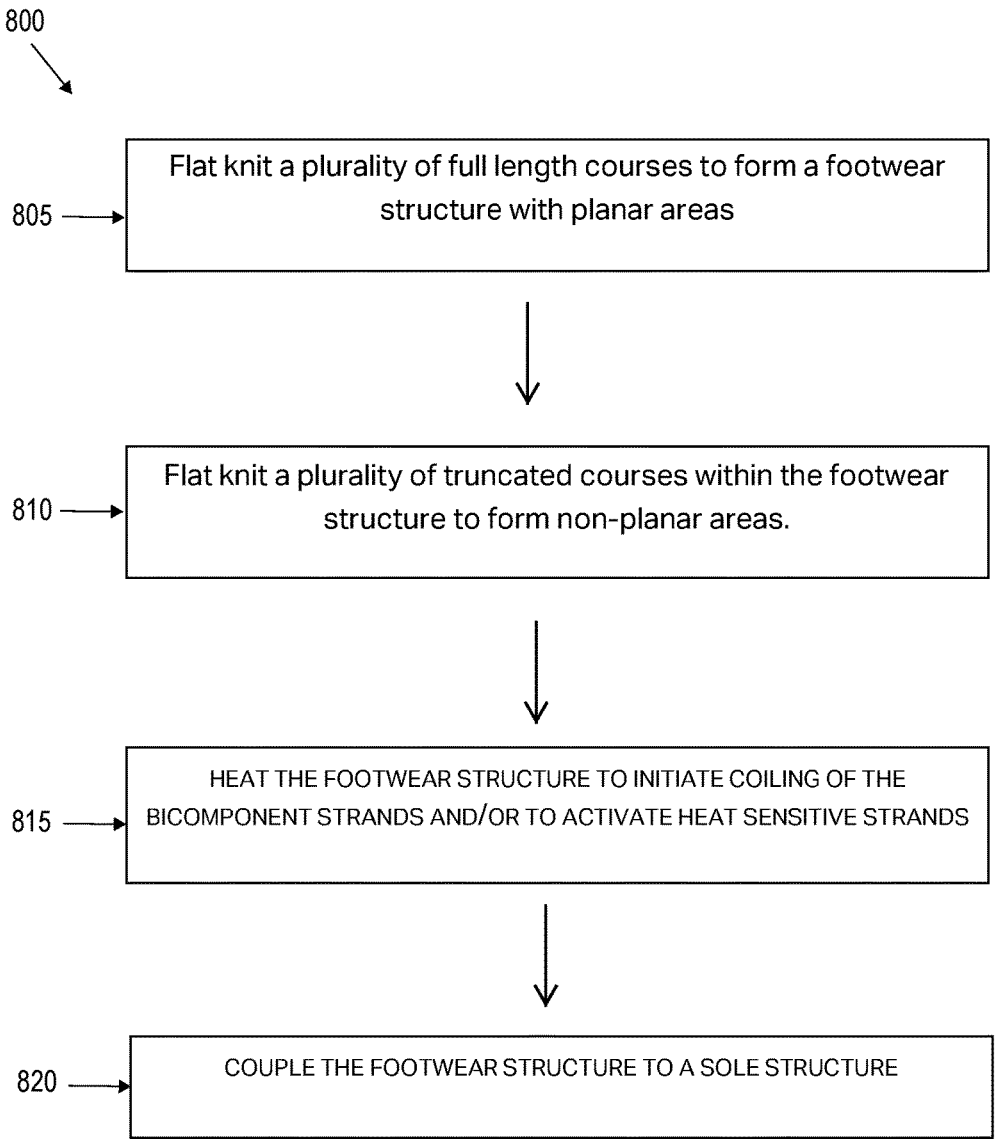
FIG. 8 is a flow chart disclosing a method of forming an article of footwear.

A method of forming an article of footwear is disclosed with reference to FIG. 8. As shown, the process 800 includes forming (via, e.g., flat knitting) a footwear structure by organizing one or more strands in courses and wales. At step 805, a plurality of full length courses is formed within the footwear structure to create planar areas. At step 810, a plurality of truncated courses is formed within the footwear structure to create non-planar areas. At Step 815, after formation of the knitted footwear structure, the footwear structure is exposed to wet or dry heat. The temperature should be sufficient to activate the bicomponent strand, generating coiling within the strand. In addition, when thermally sensitive strands are present, the temperature applied should be sufficient to initiate softening (when a softening strand), melting (when a fusible strand), or setting (when a thermosetting strand). After heating, at Step 820, the resulting footwear structure (e.g., the upper) may be coupled to the upper via adhesives, stitching, etc.

While the invention has been described in detail and with reference to specific embodiments thereof, it will be apparent to one skilled in the art that various changes and modifications can be made therein without departing from the spirit and scope thereof. For example, while most of the example embodiments depicted in the figures show an article of footwear (shoe) configured for a right foot, it is noted that the same or similar features can also be provided for an article of footwear (shoe) configured for a left foot (where such features of the left footed shoe are reflection or "mirror image" symmetrical in relation to the right footed shoe).

Within the knit structure, various stitches may be used to provide different sections 210, 215, 220, 225, 230, 240, 300 of the upper 105 with different properties. For example, a first area may be formed of a first stitch configuration, and a second area may be formed of a second stitch configuration that is different from the first stitch configuration to impart varying textures, structures, patterning, and/or other characteristics to the upper member.

Stitching may be utilized to connect sections of the upper together. In addition, a thermoplastic film may be utilized to reinforce seams, replace stitching, and/or prevent fraying. For example, seam tape available from Bemis Associates, Inc. (Shirley, Mass.) may be utilized. Instead of an instep cover 240, the upper 105 may include a conventional tongue including a longitudinally extending member free on its lateral and medial sides.

It is to be understood that terms such as "top", "bottom", "front", "rear", "side", "height", "length", "width", "upper", "lower", "interior", "exterior", "inner", "outer", and the like as may be used herein, merely describe points of reference and do not limit the present invention to any particular orientation or configuration.

Thus, it is intended that the present invention covers the modifications and variations of this invention provided they come within the scope of the appended claims and their equivalents.

What is claimed:

1. An article of footwear defining a forefoot region, a hindfoot region, and a midfoot region disposed between the forefoot region and the hindfoot region, the article of footwear including a foot cavity configured to house a foot, the article of footwear comprising:

a sole structure; and an upper coupled to the sole structure, the upper comprising a knit structure with strands of interlocked loops organized in courses and wales forming a seamless heel section, the heel seamless section including:

a curving heel cup and a footbed configured to extend between the sole structure and a bottom of the foot, wherein the courses of the knit structure within the curving heel cup include courses of varying length, and wherein the courses of varying length are organized relative to a horizontal heel axis such that course length increases in a direction away from the heel axis.

2. The article of footwear according to claim 1 further comprising:

a lateral quarter section disposed forward of the heel cup along a lateral side of the article of footwear; and a medial quarter section disposed forward of the heel cup along a medial side of the article of footwear.

3. The article of footwear according to claim 2, wherein each of the heel cup, the lateral quarter and the medial quarter are integral with the footbed of the upper.

4. The article of footwear according to claim 1, wherein the knit structure within the heel section comprises:

a first course possessing a first length;

a second course possessing a second length; and a third course oriented between the first and second courses, the third course possessing a third length, wherein the third length is less than each of the first length and the second length.

5. The article of footwear according to claim 1, wherein the footbed section extends continuously from the hindfoot region of the upper through the midfoot region of the upper, the planum section being stitchless and seamless throughout each region.

6. The article of footwear according to claim 1, wherein the strands of the knit structure are selected from the group consisting of elastic strands, inelastic strands, and heat sensitive strands.

7. The article of footwear according to claim 1, wherein the knit structure further comprises a plurality of strands fused to adjacent strands.

8. The article of footwear according to claim 1, wherein the strands of the knit structure include bicomponent strands, each bicomponent strand comprising a first component polymer and a second component polymer, the first component polymer having one or more properties that differ from one or more properties of the second component polymer.

9. The article of footwear according to claim 8, wherein the first component polymer possesses a first rate of shrinkage and the second component polymer possesses a second rate of shrinkage, the first rate of shrinkage differing from the second rate of shrinkage.

10. The article of footwear according to claim 1, wherein the upper possesses a unitary construction such that each section shares a common strand with adjacent sections.

11. The article of footwear according to claim 10, wherein each section is integral with adjacent sections.

12. The article of footwear according to claim 1, wherein the knit structure further comprises thermally conductive strands.

13. The article of footwear according to claim 12, wherein the strands of the knit structure include:

a first strand possessing a first thermal conduction value; and a second strand possessing a second thermal conduction value, wherein the first thermal conduction value is greater than the second thermal conduction value.

14. The article of footwear according to claim 1, wherein the heel section includes full courses, partially truncated courses, and fully truncated courses.

15. The article of footwear according to claim 1, wherein:

the knit structure within the heel section comprises a first course, a second course, and a third course;

the second course is truncated relative to the first course and the third course; and the third course is interlocked with each of the first course and the second course.

16. The article of footwear according to claim 1, wherein:

the knit structure comprises full courses running from a first lateral side to a second lateral side; and a partially truncated course that is truncated on one of the first lateral side and the second lateral side.

17. The article of footwear of claim 1, wherein the knit structure further includes a fully truncated course that is truncated on each of the first lateral side and the second lateral side.

18. The article of footwear according to claim 1, wherein the knit structure is a flat knit structure.

19. An article of footwear defining a forefoot region, a hindfoot region, and a midfoot region disposed between the forefoot region and the hindfoot region, the article of footwear comprising:

a sole structure; and an upper coupled to the sole structure, the upper comprising a flat knit structure formed of strands organized in courses and wales, the strands including fusible strands, wherein the upper includes a seamless, curved heel cup formed integrally with a footbed extending forward from the hindfoot region and into the midfoot region, and wherein the flat knit structure within the heel cup comprises courses of varying length.

20. The article of footwear according to claim 19, wherein:

the knit structure within the heel section comprises a first course, a second course, and a third course;

the second course is truncated relative to the first course and the third course; and the third course is interlocked with each of the first course and the second course.

* * * * *